United States Patent [19]

Brouthers et al.

[11] Patent Number: 4,581,835

[45] Date of Patent: Apr. 15, 1986

[54] RATCHETLESS GUN

[76] Inventors: Paul E. Brouthers, Reimers Rd., Monson, 01057; Robert W. MacWilliams, 313 Maple St., Springfield, both of Mass. 01105

[21] Appl. No.: 472,077

[22] Filed: Mar. 4, 1983

[51] Int. Cl.[3] ..... F41C 1/00; F41C 19/00

[52] U.S. Cl. ..... 42/65; 42/59

[58] Field of Search ..... 42/65, 66, 67, 59

[56] References Cited

U.S. PATENT DOCUMENTS

| | | | |
|---|---|---|---|
| 10,930 | 5/1854 | Peck | 42/66 |
| 11,715 | 9/1854 | Beals | 42/61 |
| 213,221 | 3/1879 | Mauser | 42/67 |
| 516,476 | 3/1894 | Couch | 42/59 |
| 520,468 | 5/1894 | Wesson | 42/65 |
| 688,217 | 12/1901 | Whiting | 42/59 |
| 990,669 | 4/1911 | Rodehaver | 42/65 |
| 1,077,135 | 10/1913 | Guerrero | 42/59 |
| 3,158,948 | 12/1964 | Freed | 42/65 |
| 3,768,190 | 10/1973 | Ruger et al. | 42/65 |
| 3,777,384 | 12/1973 | Ruger et al. | 42/65 |
| 3,797,153 | 3/1974 | Hagen | 42/59 |
| 3,810,326 | 5/1974 | Hillberg et al. | 42/65 |
| 3,918,189 | 11/1975 | Hartog | 42/65 |
| 4,001,962 | 1/1977 | Baker | 42/65 |
| 4,050,174 | 9/1977 | Hubbs | 42/59 |
| 4,128,957 | 12/1978 | Lee | 42/65 |
| 4,213,263 | 7/1980 | Brouthers | 42/65 |
| 4,307,530 | 12/1981 | Melcher et al. | 42/67 |

*Primary Examiner*—Charles T. Jordan

[57] ABSTRACT

A novel indexing system for revolvers is disclosed in which a trigger-actuated finger grabs one of a plurality of circumferentially-spaced notches on the rim of the chambered cylinder and rotates the cylinder through the required arc, as the trigger is being pulled, to advance the next chamber to its proper firing position.

The finger is part of a modular unit which fits into a complementary recess of the revolver's frame and takes the place of the standard "hand-and-ratchet" combination for rotating the cylinder. The module forms part of the recoil face and includes a stop for precisely registering the rotated chamber with the revolver's barrel just prior to firing.

16 Claims, 21 Drawing Figures

RATCHETLESS GUN

BACKGROUND OF THE INVENTION

The present invention relates to firing mechanisms for revolvers. More particularly, it relates to indexing mechanisms for automatically and sequentially rotating the cartridge chambers of a revolver's cylinder into proper firing alignment with the revolver's barrel.

Traditionally, indexing of a revolver has been achieved by a pawl or hand that is attached to the trigger and which engages a tiny ratchet that is centrally located on the rear face of the chambered cylinder. When the trigger is pulled, the hand moves vertically, engages a tooth of the ratchet and causes the cylinder to rotate.

A long-standing and well-recognized problem occurs with the "hand-and-ratchet" system. In order to obtain consistently accurate alignment of all of the chambers in the cylinder of a revolver, extremely close manufacturing tolerances are required in machining the ratchet teeth and in forming the engagement surfaces on the hand that engages the teeth. Since even close tolerances cannot invariably assure the accuracy required of quality revolvers, skilled hand-filing of these parts is usually necessary in the manufacture of a first-rate revolver. This obviously involves considerable expense.

Any imperfection in the fittings of the hand and ratchet cause a magnified error in the amount that the cylinder rotates. As taught in basic geometry courses, a slight variation near the center of a wheel in the angle or distance between two adjacent spokes results in a much greater difference in the length of the arc between the spokes at the rim of the wheel. Similarly, any imperfection between two teeth of the ratchet will cause the cylinder to rotate either too much or too little for exact alignment of the next firing chamber.

If the cartridge chamber is not aligned at the time the contained cartridge is fired, the bullet or slug in traveling from the chamber into the barrel will partially strike and shave itself on the barrel end, thereby causing dangerous splattering of lead, possible jamming of the mechanism, and distortion of the head of the slug, which, in turn, causes inaccuracy in the flight of the projectile after it leaves the barrel.

Even though skilled workers may do their best, there is always the risk of some misalignment. To overcome misalignment, several auxiliary systems have been introduced by which a stop means is used in conjunction with the hand and ratchet to precisely align the cylinder. The stop usually comprises a spring-loaded member which engages a recess in the cylinder during rotation of it to slightly move the cylinder into full alignment if necessary. In addition to correcting slight under-rotation, the stop also locks the cylinder in place and prevents over-rotation.

While these stop mechanisms are useful, they are often fragile and subject to wear. Further, they often require extremely precise timing of the trigger movement to disengage the stop from the cylinder prior to engagement of the hand with the ratchet to start rotation of the cylinder.

Accordingly, it is the primary object of the present invention to provide a new indexing system for rotating and timing a revolver cylinder that eliminates the undesirable characteristics of the "hand-and-ratchet" system presently used in revolvers.

It is another primary object to provide an indexing device which produces a more accurate index than the standard "hand-and-ratchet" system and which eliminates the need for precise fitting of parts at assembly.

It is another object to provide an improved indexing mechanism that is relatively compact and which does not require an auxiliary stop means to insure precise alignment of all the cartridge chambers with the revolver's barrel.

It is yet another object to provide a durable modular indexing unit which can be easily replaced should the need arise.

It is still a further object to provide an improved indexing mechanism for a revolver which is of relatively simple design, which may be assembled in the weapon quite easily, which can be manufactured without the skilled techniques of a gunsmith, and which can be maintained quite easily.

SUMMARY OF THE INVENTION

To accomplish the foregoing and other objects of this invention, there is provided a novel indexing system for revolvers in which a trigger-actuated finger grabs one of a plurality of circumferentially-spaced notches on the rim of the chambered cylinder and rotates the cylinder through the required arc, as the trigger is being pulled, to advance the next chamber to its proper firing position.

The finger is part of a modular unit which takes the place of the standard "hand-and-ratchet" combination for rotating a cylinder and eliminates the costly requirement for hand-filing of the hand and ratchet at assembly. The module fits into a complementary recess of the revolver's frame and forms part of the recoil face. Further, it includes a stop for precisely registering the rotated chamber with the revolver's barrel just prior to firing.

In the preferred embodiment, the invention comprises a circular backing plate which is assembled to the frame of the revolver behind the cylinder. The plate contains a firing pin hole, a stop bolt, and a center ball. Further, it includes a perpendicular projection which acts as an arbor for a bushing. The bushing has cross holes with pins which support an index yoke and allow circular travel through a restricted arc and a small reciprocating motion of the yoke. One of the cross pins is a crank pin to which an index arm is attached in essentially a horizontal position. The front of the index arm rides in a vertical slot in the frame and is connected by a pin and spring-loaded link to the trigger.

When the trigger is pulled back by a user, it engages a conventional hammer strut and starts the hammer rotating, which in turn releases the bolt from one of the notches in the cylinder's rim so that the cylinder is now free to rotate. Continued rearward movement of the trigger causes the spring-loaded link to raise the front of the index arm to the top of the frame slot and applies pressure through the crank pin to the index yoke, which has a small finger engaged in another notch of the cylinder. As the arm is raised, it "carries" the yoke with it and the finger rotates the cylinder to bring the next chamber into battery position.

The spring-loaded link allows over-travel of the trigger at the end of the trigger's stroke to release the hammer after the cylinder is in its battery position. The hammer falls, driving the stop bolt into engagement with the cylinder and advancing the firing pin to fire the cartridge.

Release of the trigger allows a standard trigger-return spring to drive the trigger forward, pulling down on the link and index arm, which forces the crank pin to pull the index finger out of engagement with the cylinder and rotate back to engage another cylinder notch.

BRIEF DESCRIPTION OF THE DRAWINGS

With the foregoing background and general summary of the invention in mind, reference is made to the accompanying drawings, in which.

DETAILED DESCRIPTION OF THE PREFERRED EMBODIMENT

Figure 1:
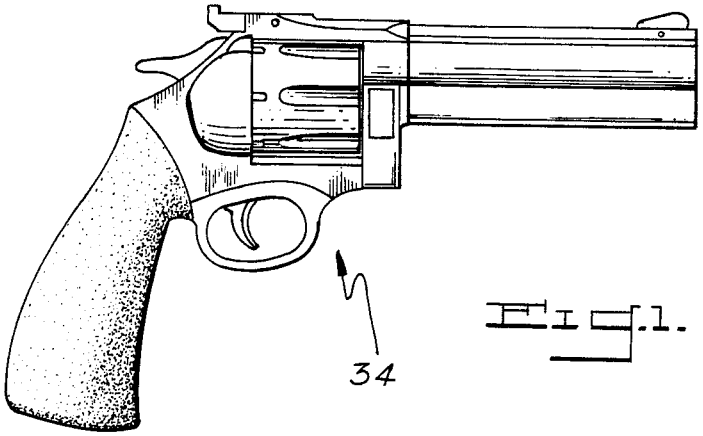
FIG. 1 is a side elevational view of a revolver incorporating the ratchetless indexing system of the present invention.
Figure 2:
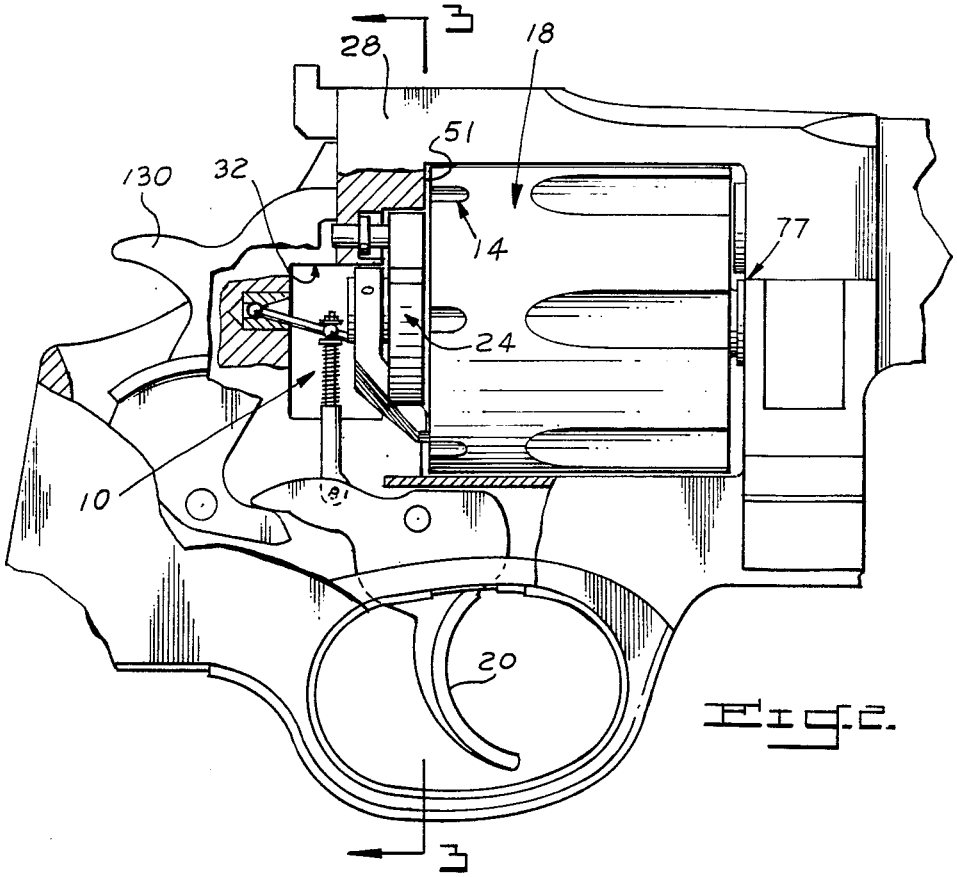
FIG. 2 is a fragmentary enlarged view of FIG. 1, with portions cut away to show details of the invention and certain standard elements removed for the sake of clarity.

Referring to the drawings in detail, a novel indexing system for revolvers is shown and generally designated by the reference numeral 10. The system basically comprises a trigger-actuated finger 12 that grabs one of a plurality of circumferentially-spaced notches 14 on the rim 16 of the multi-chambered cylinder 18 and rotates the cylinder through the required arc, as the trigger 20 is being pulled, to advance the next cartridge chamber 22 to its proper firing position. The finger 12 is part of a substantially circular, modular unit 24 that fits into a complementary recess 26 of the frame 28, and is connected to the trigger by an index arm 30 that is centrally hung behind the modular unit 24 in a vertical slot 32 in the revolver's frame.

With the exception of the illustrated indexing system 10, the preferred revolver 34 employs both the double-action firing structure and removable trigger guard assembly shown in U.S. Pat. No. 4,213,263 to Paul E. Brouthers, the disclosure of which is incorporated herein by reference. Since these elements do not form part of the present invention, they have been eliminated from the illustrated drawings for the sake of clarity. However, it should be understood that this indexing system 10 can be employed in any double-action revolver, and not just one that uses the structure of U.S. Pat. No. 4,213,263.

Figure 3:
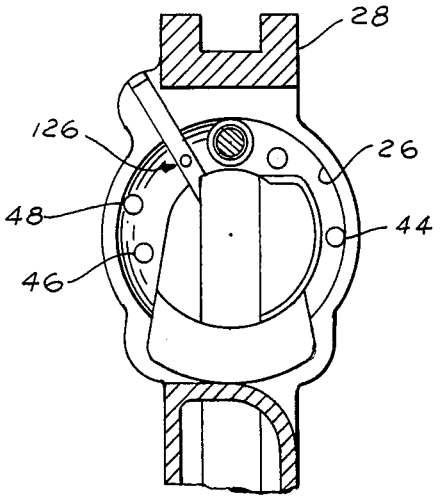
FIG. 3 is a plan view of the revolver frame taken along line 3—3 of FIG. 2, with an indexing module of the present invention removed.

As best shown in FIGS. 4–11, the modular unit 24 includes a circular backing plate 36 which is held in stationary position in the frame's complementary recess 26 by a pair of screws (not shown) that fit through illustrated edge slot 38 and bore 42 of the plate 36 and into respective "threaded" bores 44, 46 of the frame (see FIG. 3). When the modular unit 24 is inserted in the recess 26, a locating pin 48 on the frame mates with another edge slot 49 of the plate to insure that the unit is properly located. The screws are then threaded into place to removably hold the unit in the frame. In this "assembled" position, the front face 50 of the plate forms part of the recoil face 51 of the frame.

Figure 6:
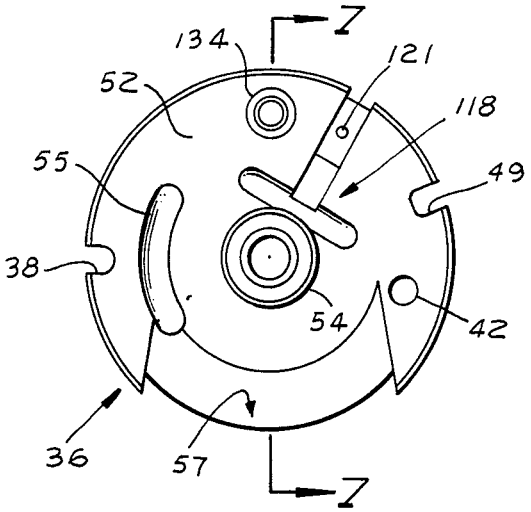
FIG. 6 is a rear plan view of a circular backing plate shown in FIG. 5.
Figure 7:
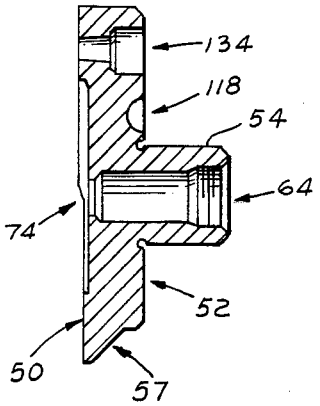
FIG. 7 is a cross-sectional view taken along line 7—7 of FIG. 6.

The plate's back face 52 includes a central bearing or perpendicular projection 54 for supporting the finger 12 so that the finger can rotate through a restricted arc (and carry the cylinder 18 with it) while the plate 36 is held in stationary position. Referring to FIG. 6, the back face 52 further includes an arcuate furrow or channel 55 for guiding the front end 56 of index arm 30 during rotation of the finger and a valley or stepped portion 57 which limits the rotational movement of the finger to approximately sixty degrees (60°) in the preferred embodiment. This 60° represents a one-sixth rotation of the cylinder or precisely the amount that a six-cartridge cylinder needs to be rotated for proper indexing.

Finger 12 is part of an index yoke 58 which is mounted on the central projection for both rotational movement thereon and limited pivoting or tilting. The yoke includes an upper stem 60 having a central bore 61 so that the stem can be slipped onto the central projection 54. It is rotatably attached to the projection by a bushing 62 (that fits between the stem bore 61 and the projection 54) and a screw 63 that fits into a countersunk, threaded bore 64 (see FIG. 7). The yoke is also attached to the bushing for slight clockwise and counterclockwise pivoting movement thereon (as viewed in FIG. 18). The "pivoting" attachment is effected by a pair of cross pins (here, crank pin 65 and step pin 66) that fit through holes 67, 68 in opposite "sides" of the yoke and into aligned holes 69, 70 in the bushing 62.

Figure 4:
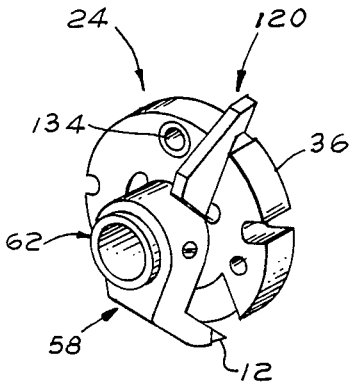
FIG. 4 is a perspective view of the indexing module which slips into a complementary recess shown in FIG. 3.
Figure 5:
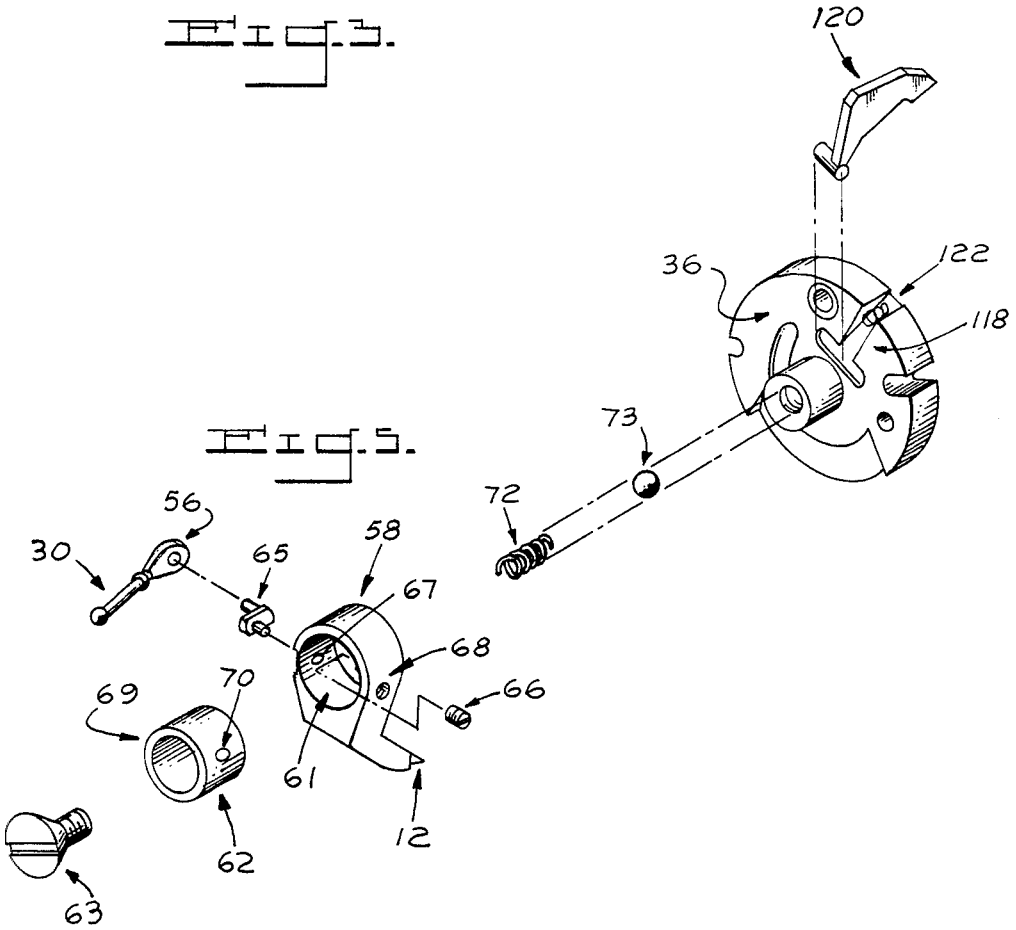
FIG. 5 is an exploded view of the module and an index h is normally attached to it.
Figure 9:
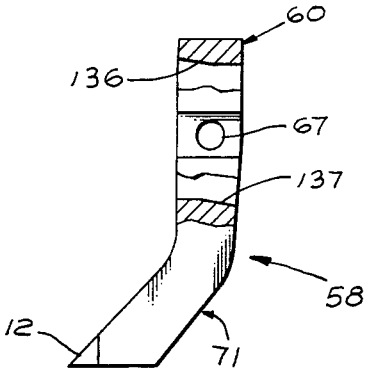
FIG. 9 is a side elevational view, partly in cross section, of an index yoke shown in FIG. 5.
Figure 10:
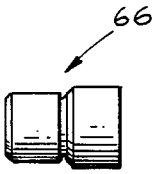
FIG. 10 is a plan view of a step pin shown in FIG. 5.

As best shown in FIGS. 4, 5 and 9, the yoke includes an integral lower portion 71 that is angularly offset from upper stem 60. This lower portion is tapered and the finger 12 extends from the end of it. Further, the finger is slightly indented from both sides of the end of the lower portion.

When the modular unit 24 is assembled, it also includes a center spring 72 and center ball 73 that are located in bore 64 between the screw 63 and the front face 50 of plate 36. A portion of the ball extends through the front face (at 74 in FIG. 7). Though not shown, in its assembled position, the spring-loaded ball 73 fits into a center hole of a standard extractor which is fixed against the rear face 75 of cylinder 18 by a shaft that fits into a hollow core 76 of the cylinder. The ball thereby supports the rear face 75 of the cylinder in a traditional manner, opposite from the support given to the cylinder's front face by a conventional crane that fits into an opposite end of the core 76 at 77.

Figure 8:
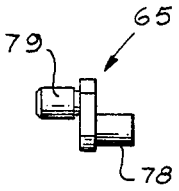
FIG. 8 is a plan view of a crank pin shown in FIG. 5.

Index arm 30 is connected to the yoke 58 by the crank pin 65 shown in FIGS. 5 and 8. The crank pin has a flat center body from which parallel pins 78, 79 oppositely extend. One of the pin portions 78 fits into hole 67 in the upper stem of the yoke and the opposite pin 79 fits into a bore in the front end 56 (here, a flat oval portion 80) of the index arm. In addition to the flat portion 80, the index arm includes an angularly offset stem 82 with a center ball bearing 84 and a rear ball bearing 86. The rear ball bearing is rotatably fitted into a bushing 88 housed in a horizontally-extending bore that has been previously drilled in the revolver frame 28.

Frame bushing 88 has a divergent channel 89 so that the front end 56 of arm 30 is permitted to pivot up and down in the frame slot 32 between the bushing 88 and the modular unit 24.

Arm 30 is connected to the trigger 20 by an upper link 90 that surrounds the center ball bearing 84 and by a spring-loaded lower link 92 that connects the upper link to a pivot pin 94 on the trigger. The upper link 90 includes a convergent channel 96 (see FIG. 20) which provides a bushing for the center bearing and allows the index arm to pivot slightly side-to-side when the front end of the arm moves in the arcuate furrow 55 of plate 36 during indexing. The upper link has a guide bore 98 through it for telescopically receiving a guide shaft 100 of the lower link. This permits reciprocal movement of the shaft in the guide bore during indexing.

Figure 21:
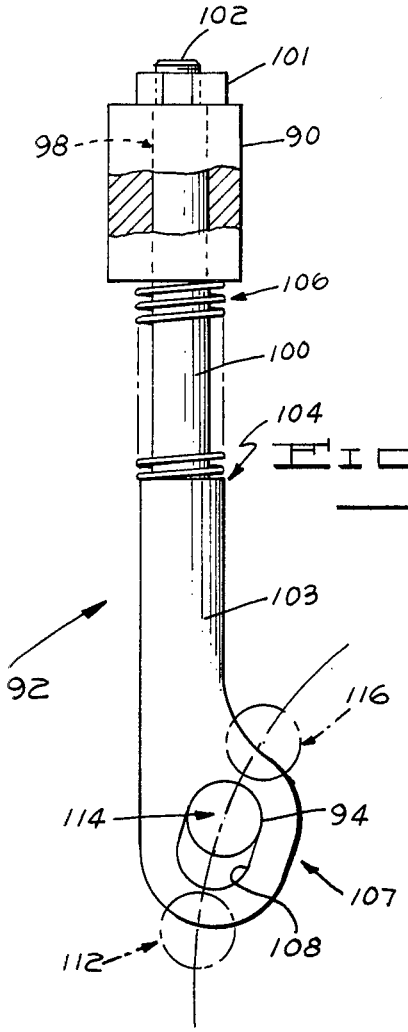

As best shown in FIG. 21, the upper link 90 and lower link 92 are secured together by a nut 101 which fits over a threaded end portion 102 of the guide shaft 100 that extends through the top of link 90. The nut rests on top of the upper link 90 when the guide shaft is in its fully extended position shown in FIG. 21 but moves with the guide shaft during indexing.

The lower link 92 includes a bottom portion 103 that is integral with the guide shaft 100, but wider than it, and has a step 104 on which a coil spring 106 is mounted. The spring allows reciprocal movement of the guide shaft in the bore 98 but normally biases the shaft to its fully extended position. At the opposite end of the bottom portion from step 104, the bottom terminates in a widened, oval portion 107 having an elongated hole 108 to produce a "lost motion" during initial trigger movement to allow trigger and hammer strut engagement prior to yoke actuation.

Figure 14:
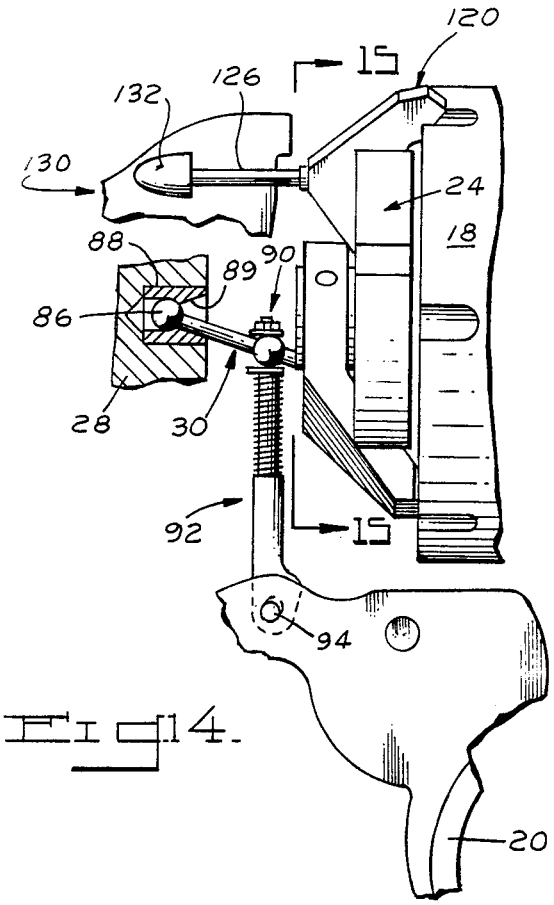
FIG. 14 is an enlarged view of the indexing mechanism shown in FIG. 2, with the trigger being illustrated at its fully-extended or "rest" position.
Figure 15:
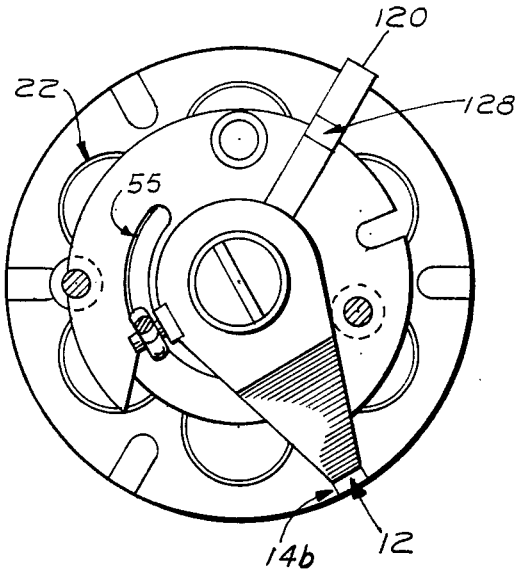
FIG. 15 is a rear plan view of the indexing module taken along line 15—15 of FIG. 14, which shows the position of the yoke when the trigger is at rest.
Figure 18:
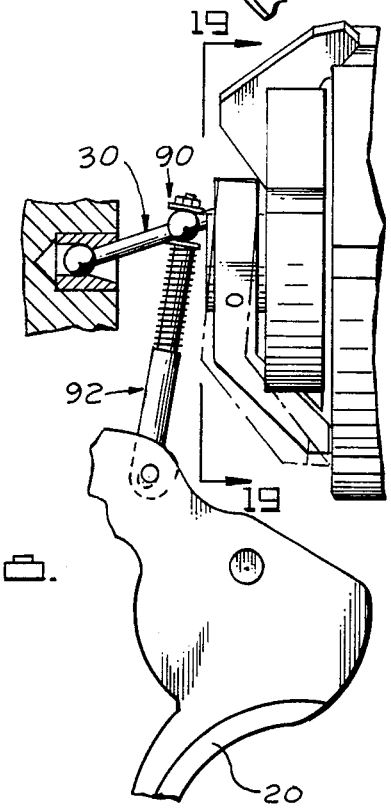
FIG. 18 is a view similar to FIG. 16, but with the trigger having been pulled all the way back and the hammer having just "fired" the cartridge.

Referring again to FIG. 21, the trigger pivot pin 94 is shown in three positions: the position illustrated at 112 which shows the trigger pivot pin when the trigger is in its "rest" position (shown in FIG. 14); the position 114 of the pivot pin when the trigger is pulled halfway back by a user (shown in FIG. 16); and the position 116 of the pin when the trigger has been pulled all the way back and the hammer has just "fired" the next cartridge (see FIG. 18).

Figure 20:
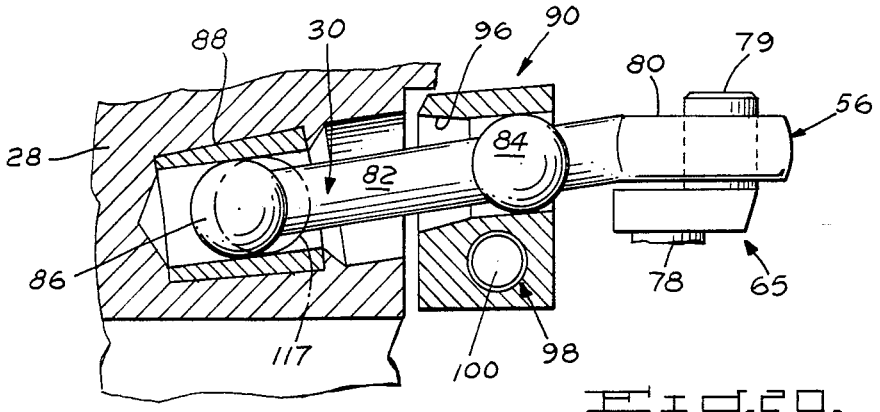
FIG. 20 is a top view of the crank pin, the step pin, an upper link bushing and the frame bushing of the invention, with portions taken away; and, FIG. 21 is an enlarged, side elevational view of the upper link and a lower link that are used to connect the index arm of FIG. 20 to the trigger.

In FIG. 20, the rear ball bearing 86 is illustrated in two positions, to show the corresponding positions of the bearing for each of the trigger pivot pin positions shown in FIG. 21. The phantom illustration 117 of the bearing represents the positions of the bearing at both the "bottom" and "top" pin positions 112 and 116. Note that in these trigger pivot pin positions, the ball bearing is slightly forward of the position it occupies when the trigger pivot pin is in its "middle" or 114 position.

Figure 11:
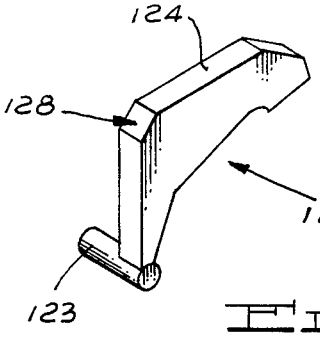
FIG. 11 is a perspective view of a stop bolt shown in FIG. 5.
Figure 12:
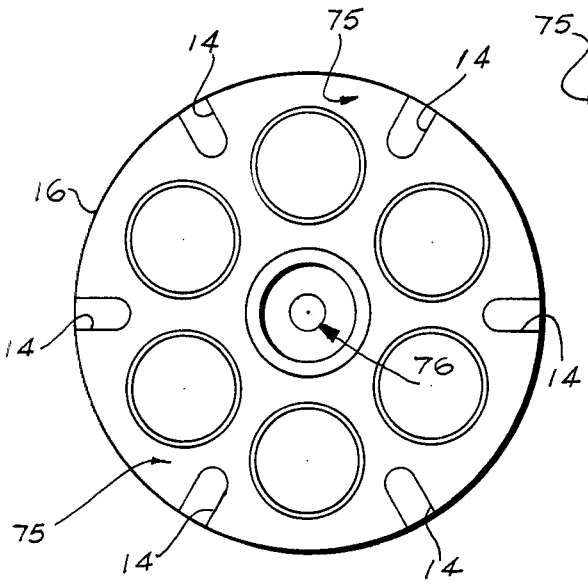
FIG. 12 is a plan view of the rear face of the revolver cylinder shown in FIG. 2.
Figure 13:
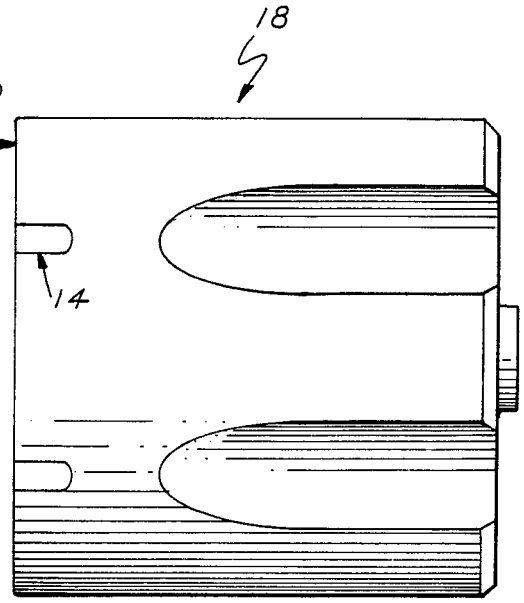
FIG. 13 is a side plan view of the cylinder, with the cylinder slightly rotated from its FIG. 12 position.
Figure 19:
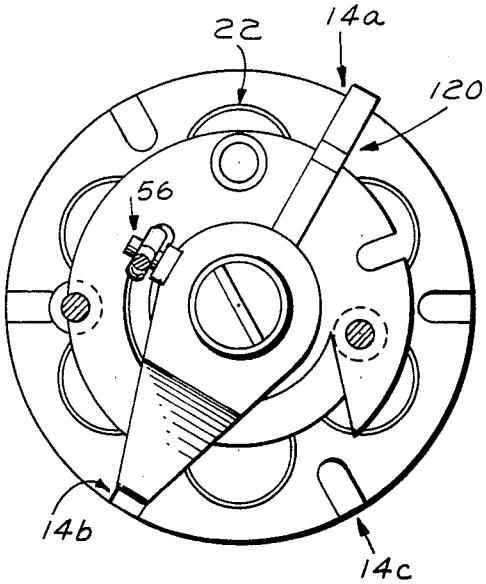
FIG. 19 is a rear plan view of the module taken along line 19—19 of FIG. 18, which shows the location of the yoke during firing.

In addition to the previously mentioned elements, the back face 52 of the backing plate 36 includes a T-channel 118 for pivotally housing a spring-loaded stop bolt 120 for the indexing system 10. The stem of the "T" is sloped (see FIG. 5) and includes a small bore 121 (see FIG. 6) for housing a tiny coil spring 122 for biasing the stop away from the rear face and notches 14 of the cylinder 18. As best shown in FIG. 11, the stop 120 bolt comprises a pivot pin 123 that fits into the T-channel and a pawl 124 that can grab a notch **14*a* in the cylinder 18 to lock the cylinder and prevent it from rotating. As shown in FIG. 19, this notch 14*a* is approximately one-hundred-eighty degrees (180°) away from the position of the notch 14*b* engaged by the finger 12** just prior to firing.

Though the stop bolt 120 is normally biased away from the notches 14 by spring 122, it can be forced into engagement with the adjacent notch **14*b* by an engagement pin 126 in the frame (see FIGS. 3 and 14) that acts against a flat engagement surface 128 on the pawl. However, the hammer 130 includes a conical projection 132 which fits through a complementary recess in the revolver frame (not shown) that is contiguous with the traditional hammer slot. When the hammer falls during firing, the projection 132 passes into the recess where it engages an exposed end of the pin 126 and pushes the pin into engagement with the bolt's engagement surface 128, which forces the bolt to pivot in the T-channel 118 and its pawl 124 to grab the notch 14*a***.

OPERATION OF THE INDEXING SYSTEM

Figure 16:
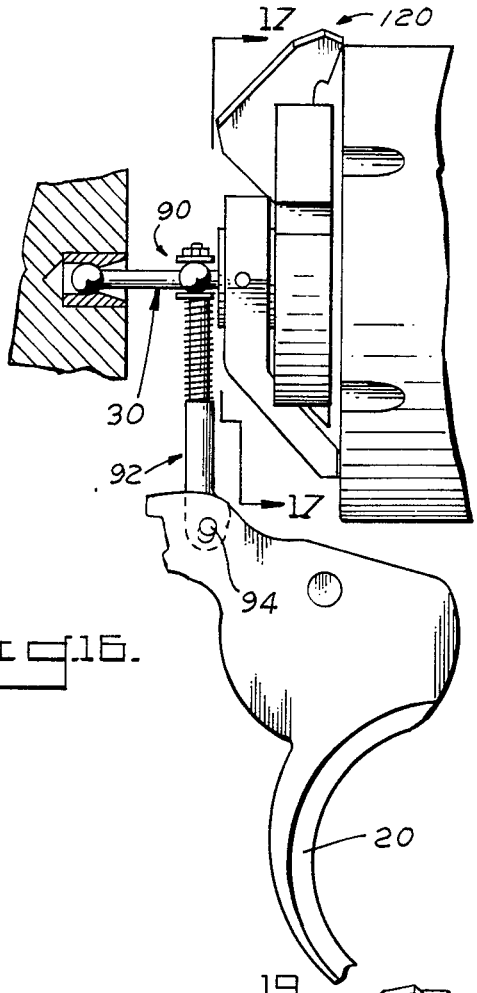
FIG. 16 is a view similar to FIG. 14, with the trigger being pulled halfway back.
Figure 17:
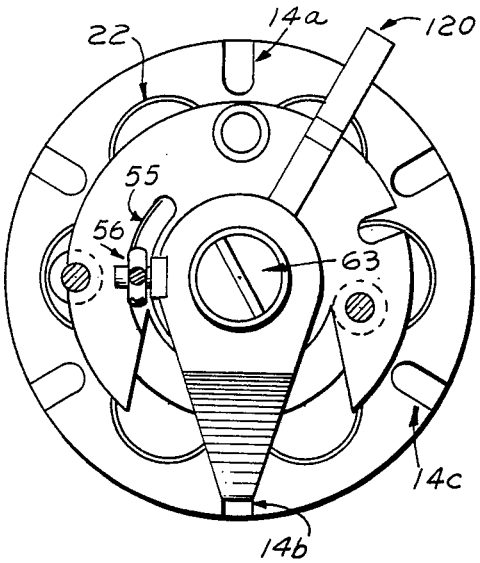
FIG. 17 is a rear plan view of the module taken along line 17—17 of FIG. 16, which shows the cylinder being rotated halfway to its next firing position.

The operation of the system 10 is shown in FIGS. 14–19. When the trigger 20 is pulled back by a user from its FIG. 14 "rest" position, it engages a conventional hammer strut (not shown) and starts the hammer 130 rotating, which in turn releases the stop bolt 120 from a registered notch in the cylinder's rim 16 so that the cylinder is now free to rotate. Continued rearward movement of the trigger (as shown in FIGS. 16 and 18) causes the spring-loaded lower link 92 to raise the front end 56 of index arm 30 to the top of the frame slot 32 and applies pressure through the crank pin 65 to the index yoke 58, which has its trigger-actuated finger 12 engaged in another notch (**14*b*) of the cylinder. As the arm is raised, it "carries" the yoke with it and the finger 12 rotates the cylinder 18 through the required arc (here, 60°) to bring the next chamber 22** into battery position.

The spring-loaded link 92 centers the index arm 30 and allows over-travel of the trigger 20 at the end of the trigger's stroke to release the hammer 130 after the cylinder is in its battery position. The hammer 130 falls, driving the stop bolt 120 into engagement with the cylinder and advancing the firing pin through a 12 o'-clock bore 134 in backing plate 36 to fire the cartridge. Though not shown, the firing is preferably achieved in the illustrated revolver 34 by a conventional transfer bar that is pivotally connected to the trigger and located between the hammer and the firing pin during percussion.

Release of the trigger allows a standard trigger-return spring (not shown) to drive the trigger forward, pulling down on the links 90, 92 and index arm 30, which forces the yoke 58 to pivot slightly on the cross pins 65, 66 (see the phantom illustration in FIG. 18) to pull the index finger 12 out of engagement with the cylinder. This allows the finger to rotate freely back to its FIG. 14 position where it can engage another cylinder notch 14*c*. This pivoting means of disengagement is allowed by slightly sloped walls 136, 137 of the yoke which are shown in FIG. 9.

While the finger is rotated back to engage the "new" notch 14*c*, the stop bolt 120 holds the cylinder still. This ensures that the notch 14*c* will remain in the proper location for alignment with and engagement by the finger.

If for some reason a cartridge is not closely aligned with the revolver's barrel during falling of the hammer (for example, when the indexing system 10 is clogged with dirt and a "full" rotation (60°) of the cylinder has not taken place), the stop bolt will refuse to slip into the adjacent notch and will prevent firing of the cartridge. In the absence of a substantially full rotation, the pawl 124 of the bolt rests against the rear face 75 of the cylinder, in a position similar to that shown in FIGS. 16 and 17. In this position, the engagement surface 128 of the bolt is slightly rearward from its battery position shown in FIG. 18. The surface 128 acts with the pin 126 against the projection 132 on the hammer to stop the hammer from striking the transfer bar, and thus prevent percussion from taking place.

It should be understood by those skilled in the art that obvious structural modifications can be made without departing from the spirit of the present invention. Accordingly, reference should be made primarily to the accompanying claims, rather than to the foregoing specification, to determine the scope of the invention.

Having thus described the invention, what is claimed is:

1. In a double-action revolver of the type having a multi-chambered cylinder mounted for rotation in a frame, said cylinder having a front face at one end near the revolver's barrel, a rear face at its opposite end near a recoil face of the frame and a side surface of revolution that is substantially perpendicular to and connects the two faces, a novel indexing system for automatically and sequentially rotating the cartridge chambers of the cylinder into proper firing alignment with the revolver's barrel, said system comprising:

(a) a plurality of circumferentially-spaced notches along the rim of the cylinder's rear face, wherein the notches are located at the junction of the rear face and the cylinder's side surface and extend into both the rear face and the side surface; and, (b) trigger-actuated means for gripping one of the notches and rotating the cylinder through the required arc, as the trigger is being pulled, to advance the next cartridge chamber into proper firing alignment.

2. In a double-action revolver of the type having a multi-chambered cylinder mounted for rotation in a frame, a novel indexing system for automatically and sequentially rotating the cartridge chambers of the cylinder into proper firing alignment with the revolver's barrel, said system comprising:

(a) a plurality of circumferentially-spaced notches along the rim of a rear face of the cylinder; and, (b) trigger-actuated means for gripping one of the notches and rotating the cylinder through the required arc, as the trigger is being pulled, to advance the next cartridge chamber into proper firing alignment, wherein the trigger-actuated means comprises a modular unit that fits into a complementary recess of the revolver's frame and the unit includes a yoke that grabs the notches and which is connected to the trigger by linkage means.

3. The indexing system of claim 2 wherein the linkage means comprises an index arm that rides in a vertical slot in the frame, wherein one end of the arm is connected to the yoke, an opposite end of the arm is pivotally connected to the frame, and the arm is connected along its mid-length to the trigger by a trigger pivot pin and a spring-loaded link.

4. The indexing system of claim 2 wherein the modular unit includes a stop means to ensure precise alignment of said next cartridge chamber with the revolver's barrel just prior to firing.

5. The indexing system of claim 2 wherein the modular unit includes a substantially circular backing plate that is detachably fixed to the frame in a stationary position, wherein one side of the plate forms a part of the recoil face of the frame, and the opposite side has a perpendicularly-extending projection that supports a bushing for rotatably supporting the yoke thereon.

6. The indexing system of claim 5 wherein the bushing includes a pair of cross pins which support the index yoke for limited pivotal movement thereon and also includes an additional means for permitting circular travel of the yoke through a restricted arc.

7. The indexing system of claim 5 wherein the modular unit includes a stop means to ensure precise alignment of said next cartridge chamber with the revolver's barrel just prior to firing, said stop means comprising a spring-loaded pawl that is pivotally attached to a back face of the backing plate and which is adapted to be driven into engagement with another one of said notches by a projection on the revolver's hammer.

8. An indexing system for revolvers comprising:

(a) a multi-chambered cylinder mounted for rotation in a frame of a revolver, said cylinder having a front face at one end near the revolver's barrel and a rear face at its opposite end near a recoil face of the frame;

(b) a plurality of circumferentially-spaced notches along the rim of the rear face; and, (c) trigger-actuated means for gripping at least one of the notches and automatically and sequentially rotating the chambers of the cylinder into proper firing alignment with the revolver's barrel as the trigger is being pulled, said trigger-actuated means comprising a modular unit housed in a complementary recess of the frame's recoil face, wherein the unit has a rotatable yoke connected to the trigger by linkage means so that the yoke is adapted to grip said notch and rotate the cylinder through the required arc, as the trigger is being pulled, to advance the next cartridge chamber into proper firing alignment.

9. The indexing system of claim 8 wherein the linkage means comprises an index arm that rides in a vertical slot in the frame, wherein one end of the arm is connected to the yoke, an opposite end of the arm is pivotally connected to the frame, and the arm is connected along its mid-length to the trigger by a trigger pivot pin and a spring-loaded link.

10. The indexing system of claim 8 wherein the modular unit includes a stop means to ensure precise alignment of said next cartridge chamber with the revolver's barrel just prior to firing.

11. The indexing system of claim 8 wherein the modular unit includes a substantially circular backing plate that is detachably fixed to the frame in a stationary position, wherein one side of the plate forms a part of the recoil face of the frame, and the opposite side has a perpendicularly-extending projection that supports a bushing for rotatably supporting the yoke thereon.

12. The indexing system of claim 11 wherein the bushing includes a pair of cross pins which support the index yoke for limited pivotal movement thereon and also includes an additional means for permitting circular travel of the yoke through a restricted arc.

13. The indexing system of claim 11 wherein the modular unit includes a stop means to ensure precise alignment of said next cartridge chamber with the revolver's barrel just prior to firing, said stop means comprising a spring-loaded pawl that is pivotally attached to a back face of the backing plate and which is adapted to be driven into engagement with another one of said notches by a projection on the revolver's hammer.

14. An indexing method for automatically and sequentially rotating the chambers of a revolver's cylinder into proper firing alignment with the revolver's barrel, wherein said cylinder is of the type having a front face at one end near the revolver's barrel, a rear face at its opposite end near a recoil face of the frame and a side surface of revolution that is substantially perpendicular to and connects the two faces, said method comprising:

(a) forming a plurality of circumferentially-spaced notches along the rim of the cylinder's rear face, wherein the notches are located at the junction of the rear face and the cylinder's side surface and extend into both the rear face and the side surface; and, (b) automatically gripping one of the notches and rotating the gripper through the required arc, as the revolver's trigger is being pulled, to rotate the gripped cylinder and advance the next cartridge chamber to its proper firing position.

15. An indexing system for revolvers comprising:

(a) a multi-chambered cylinder mounted for rotation in a frame of a revolver, said cylinder having a front face at one end near the revolver's barrel and a rear face at its opposite end near a recoil face of the frame; and, (b) trigger-actuated means for automatically and sequentially rotating the chambers of the cylinder into proper firing alignment with the revolver's barrel as the trigger is being pulled, said trigger-actuated means comprising a modular unit removably housed in a complementary recess of the frame's recoil face, wherein a back face of the unit is substantially flat and substantially flush with the frame's recoil face to form at least a part thereof.

16. The indexing system of claim 15 wherein the unit has an opposite or front face that is connected to the trigger by linkage means located in a slot behind the recoil face.

* * * * *